United States Patent [19]

Hardesty

[11] 3,954,320

[45] May 4, 1976

[54] ELECTRICAL CONNECTING DEVICES FOR TERMINATING CORDS

[75] Inventor: Edwin Charles Hardesty, Perry Hall, Md.

[73] Assignee: Western Electric Company, Inc., New York, N.Y.

[22] Filed: Nov. 6, 1974

[21] Appl. No.: 521,429

Related U.S. Application Data

[63] Continuation-in-part of Ser. No. 377,154, July 6, 1973, Pat. No. 3,860,316.

[52] U.S. Cl. ..... 339/99 R; 339/103 M

[51] Int. Cl.[2] ..... H01R 11/20

[58] Field of Search ..... 339/91, 97–99, 339/103, 107, 176

[56] References Cited

UNITED STATES PATENTS

| | | | |
|---|---|---|---|
| 3,569,914 | 3/1971 | Taylor et al. | 339/107 |
| 3,576,518 | 4/1971 | Bazille et al. | 339/98 |
| 3,621,449 | 11/1971 | Bridle | 339/99 R |
| 3,699,498 | 10/1972 | Hardesty et al. | 339/99 R |
| 3,761,869 | 9/1973 | Hardesty et al. | 339/99 R |
| 3,860,316 | 1/1975 | Hardesty | 339/99 R |

*Primary Examiner*—Joseph H. McGlynn
*Attorney, Agent, or Firm*—E. W. Somers

[57] ABSTRACT

A plug for terminating a cord includes an unipartite, non-hinged, dielectric housing with a free end and a cord-input aperture in the other end and with internal surfaces defining a cavity. A jacket anchoring member is formed integrally of the housing and has a surface which protrudes into the cavity slightly beyond the adjacent surface of a portion of the remainder of the housing adjacent the cord-input aperture when the anchoring member is in an initial position. Forces are applied to the anchoring member to partially disconnect it from the housing and move it into an actuated position with substantially all of the protruding surface in clamping engagement with the jacket and with a portion of another surface of the anchoring member into locking engagement with a portion of the remainder of the housing adjacent the cord-input end of the housing. Another portion formed integrally with the housing is reformed into a strain relief element in engagement with the conductors. Terminals are inserted into terminal-receiving openings in the dielectric housing to move internal contacting portions thereof into engagement with conductors of the cord. External contacting portions of the terminals engage electrically associated components of a telephone apparatus when the plug is inserted thereinto. The arrangement is such that the locking engagement of the anchoring member with the remainder of the housing is maintained during the application of retrograde forces to the cord by a customer during use.

8 Claims, 11 Drawing Figures

ELECTRICAL CONNECTING DEVICES FOR TERMINATING CORDS

CROSS REFERENCE TO RELATED APPLICATION

This is a continuation-in-part of my copending application, Ser. No. 377,154 filed July 6, 1973 now U.S. Pat. No. 3,860,316.

BACKGROUND OF THE INVENTION

1. Field of the Invention

This invention relates to electrical connecting devices for terminating cords, and more particularly, to devices for making electrical connections between a cord comprising flexible conductors and terminals which includes strain-relief facilities for the cord which, surprisingly, are maintained effective during the application of retrograde forces to the cord during use by the customer.

2. Description of the Prior Art

In the telephone industry, increasing use is being made of modular plug type connectors on straight and retractile handset and line cords which are used between the base and a handset of a telephone and between the base and a wall terminal block. In the presently used plugs, a terminal is applied to each of a plurality of insulated conductors contained within a jacketed length of a retractile cordage. These terminals are mounted within a dielectric structure which is attached securely to the associated cordage. The dielectric portions of the plugs, which are mounted on both ends of a length of cordage, cooperate with receptacles in the handset and in the base of the telephone to properly align the terminals of the plug with mating terminals within the components of the telephone.

In one presently used plug disclosed in U.S. Pat. No. 3,699,498 issued on Oct. 17, 1972 in the names of E. C. Hardesty, C. L. Krumreich, A. E. Mulbarger, Jr. and S. W. Walden, conductors are confined in conductor-receiving troughs formed in a dielectric base by a cover bonded to the base. Flat terminals are then inserted into individual grooves in the base in a side-by-side arrangement with contact portions thereof extending into engagement with the conductors. When the plug is inserted into a jack of a telephone handset, portions of the terminals in the jack engage portions of associated terminals in the plug.

Provisions in the just-identified plug for contacting the external component may be changed to that described in U.S. Pat. No. 3,761,869 issued on Sept. 25, 1973 in the names of E. C. Hardesty, C. L. Krumreich, A. E. Mulbarger, Jr. and S. W. Walden. There, the external contact portions of the terminals of the plug consist of an edge exposed to the exterior of the dielectric enclosure, There has been some thought given to the cost involved in insuring a reliable securing together of the parts of the plug shown in U.S. Pat. No. 3,699,498. It would be desirable both from the ease and the cost of manufacturing to construct a one-piece plug, into which a telephone cord end may be inserted and secured and subsequently engaged by terminals moved into terminal-receiving openings in the plug.

SUMMARY OF THE INVENTION

This invention provides electrical connecting devices for terminating cords. A dielectric portion of the device can be fabricated in one-piece by using conventional molding techniques. The device may be assembled to a line cord or to a retractile cord either before or after the cord is heat treated to achieve retractile properties.

An electrical connecting device which embodies the principles of this invention is molded to include a one-piece or unipartite dielectric housing having a free end and further which includes a cavity that opens to a cord-input end of the housing for receiving an end section of a telephone cord. Unipartite or one-piece as used to describe the housing is intended to define the housing as not divided or divisible into parts. Moreover, the housing is molded so that no securing, including bonding, nor moving of hinged or otherwise moveable parts is necessary to form the initial configuration of the housing. The surfaces of the housing as molded define the cavity and substantially enclose the end portion of the cord. The housing is formed with at least one portion adjacent the cavity connected pivotally to the remainder of the housing toward the free end thereof and having a surface which protrudes into the cavity slightly beyond the adjacent surface of a portion of the remainder of the housing adjacent the cord-input end of the housing when the pivotally moveable portion is in an initial position. The pivotally connected portion is capable of being moved from the initial position to an actuated position at least partially into the cavity with substantially all of the protruding surface engaging and clamping portions of the cord, and with a portion of another surface of the pivotally moveable portion engaging in locking relationship a portion of the remainder of the housing adjacent the cord-input end of the housing. The locking relationship is maintained during the application of retrograde forces to the cord. A plurality of electrically conductive terminals are positioned within the housing and extend between the cavity for piercing the insulation of and making electrical engagement with associated conductors of the cord and an external surface for making electrical contact external to the connector.

BRIEF DESCRIPTION OF THE DRAWINGS

Other features of the present invention will be readily understood from the following detailed description of specific embodiments thereof when read in conjunction with the accompanying drawings, in which.

DETAILED DESCRIPTION

Overall

Figure 1:
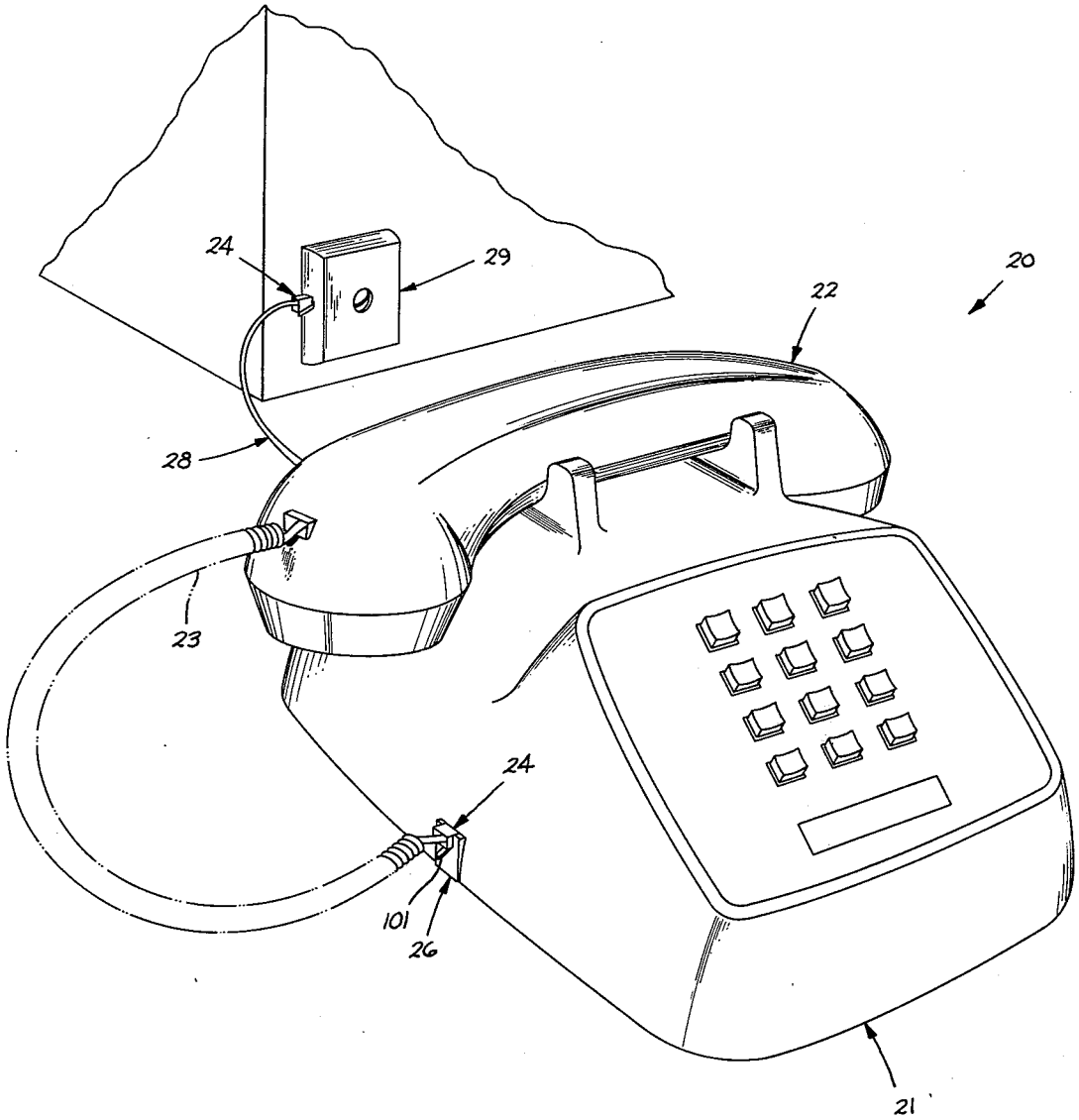
FIG. 1 is a perspective view showing plugs which embody the principles of this invention inserted into a handset and base portion of a telephone set and into a wall terminal.

Referring now to FIG. 1, there is shown a telephone, designated generally by the numeral 20, which includes a base portion, designated generally by the numeral 21, and a handset portion, designated generally by the numeral 22. A retractile cord, designated generally by the numeral 23, interconnects the base portion 21 and the handset portion 22.

Each end of the retractile cord 23 is provided with a plug, designated generally by the numeral 24, designed to be inserted into a jack 26. One of the plugs 24—24 is inserted into one of the jacks 26—26 assembled to the handset end and the other plug of the retractile cord 23 inserted into a jack in the base of the telephone 20. The plug 24 has facilities for establishing electrical connections between the cord 23 and internal contacting components 27—27 of the telephone 20 (see FIG. 10). Ones of the plugs 24—24 are also assembled to each end of a line cord, designated generally by the numeral 28 (see FIG. 1), for connecting the line cord to jacks 26—26 in the telephone base and in a wall terminal block 29.

Figure 5:
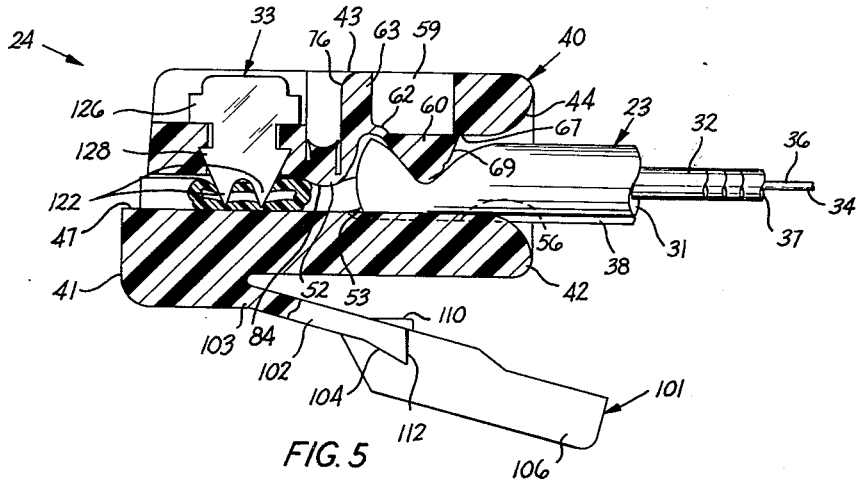
FIG. 5 is an elevational view partially in section subsequent to the assembly of the cord and the plug showing the jacket strain relief member of the plug after having been moved into engagement with the jacket of the cord to provide strain relief for the cord and a portion of the housing having been reformed into a strain relief member in engagement with the conductors and also showing the terminals inserted.

Referring now to FIG. 5, a more detailed view of the structure of the retractile cord 23 can be seen. The retractile cord 23 includes a jacket 31 covering a plurality of insulated conductors 32—32. A free end portion of each of the conductors 32—32 is designed to be connected to an associated one of a plurality of terminals, designated generally by the numerals 33—33. Each of the conductors 32—32 is constructed of a nylon core 34 having a tinsel ribbon 36 wrapped helically thereabout. The tinsel ribbon 36 has an insulation covering 37 extruded thereabout with a ridge 38 (see FIG. 10) formed longitudinally thereof. The outside nominal diameter of the individual insulated conductors 32—32 is approximately 0.037 inch.

Miniature plugs constructed in accordance with the present inventions permit the expeditious connection of cord ends to the completed dielectric portion of the plugs rather than to a dielectric subassembly which must then be assembled to at least one other subassembly. This avoids having to maintain the cord 23 in a predetermined position in the subassembly while assembling the dielectric portion of the plug.

DIELECTRIC PORTION

Figure 2:
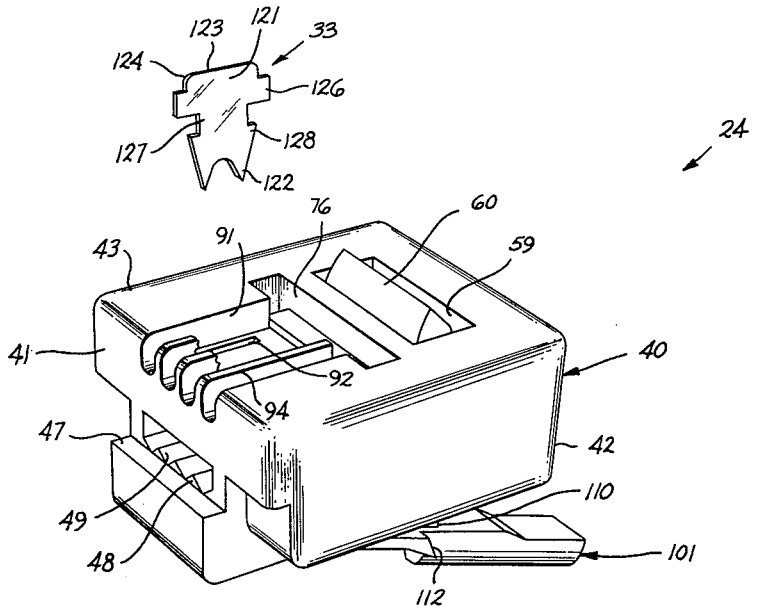
FIG. 2 is a perspective view of one of the plugs prior to assembly of a cord and terminals therewith for purposes of clarity and further showing an internally moveable jacket strain relief member of the plug prior to movement thereof.
Figure 3:
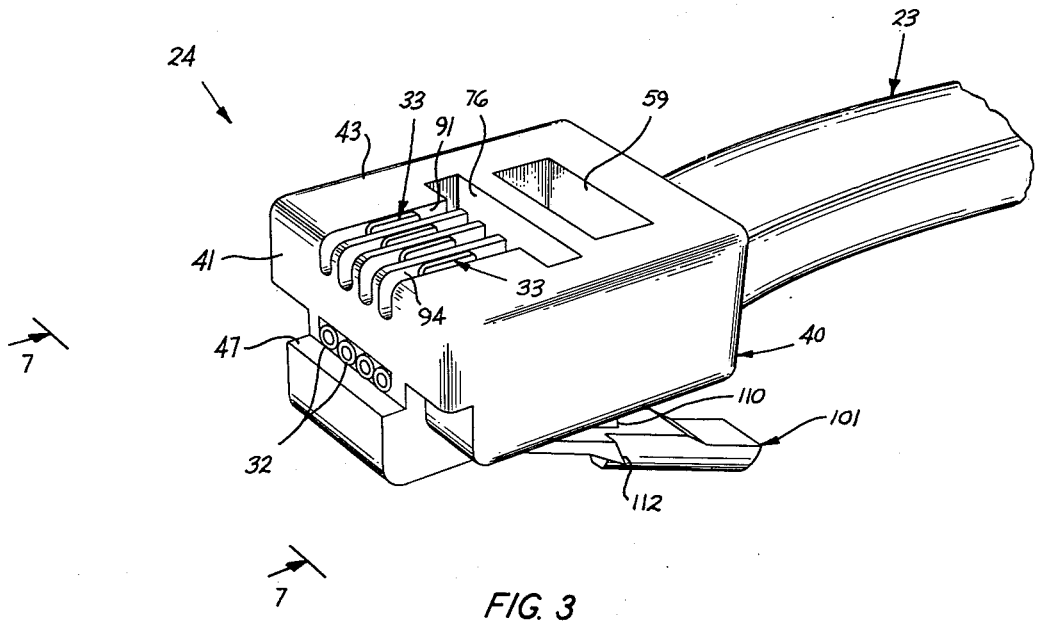
FIG. 3 is a perspective view of the plug shown in FIG. 2 with terminals and the cord end inserted into the plug and with the jacket strain relief member having been moved into engagement with the cord which has been inserted into the plug.
Figure 4:
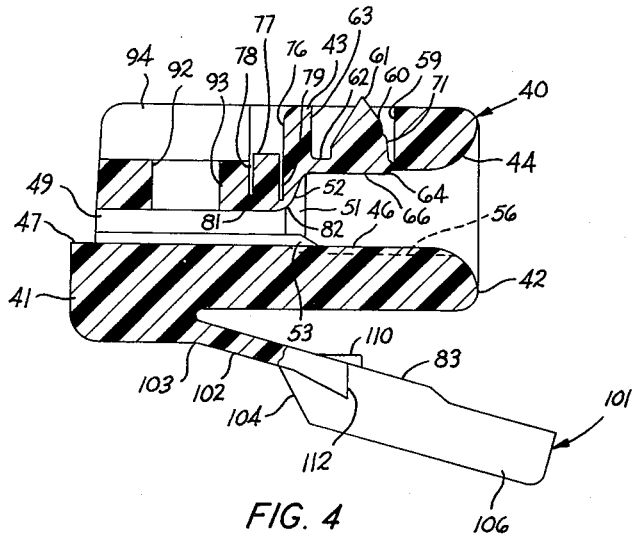
FIG. 4 is an elevational view of a housing of the plug partially in section prior to the assembly of the cord and terminals therewith.
Figure 7:
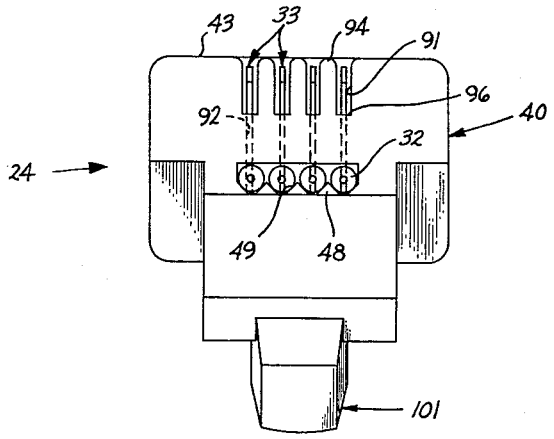
FIG. 7 is a front end view of the plug shown in FIG. 3 and taken along lines 7-7 thereof.

The detailed construction of a plug 24 is shown in FIGS. 2, 4 and 7. A rigid, dielectric unipartite housing, designated generally by the numeral 40, is designed to be easily molded by using conventional injection molding techniques. The rigid, dielectric housing 40 has a free end 41, a cord-input end 42, and a terminal-receiving side 43 (see also FIG. 3).

It may be observed from FIGS. 4 and 5 that the housing 40 is formed with a cord-input aperture 44 which circumscribes substantially the portion of the jacket 31 of the cord 23 extending therethrough. As may be appreciated from the drawing, the housing 40 is constructed in one-piece with the cord input aperture 44 formed entirely therewithin. The aperture 44 has a flared entrance which prevents sharp bends in the cord 23 about an otherwise sharp edge during use of the telephone 10 by the subscriber. This advantageously increases the life of the cord 23. The flared entrance also facilitates insertion of a leading end of the cord 23.

The cord input aperture 44 opens to a cavity 46 (see FIG. 4) which partially terminates in a ledge 47 at the free end 41 of the base of the housing 40. The cavity 46 substantially encloses the entire end section of the cord which is inserted into the aperture 44 and is completely formed as molded. No further securing together of parts such as by bonding or moving of hinged parts with subsequent bonding together is required to form the cavity 46.

The formation of a one-piece housing 40 with the surfaces defining the cavity 46 substantially enclosing the entire end portion of the cord 23 facilitates holding the cord while other operations are performed by automated equipment. In prior art connectors, the cord 23 is generally positioned in a portion of a conductor-access opening formed in a base and then a lid bonded to the base. This, of course, will not suffice to hold the cord 23 in the base during assembly without additional steps and equipment. Moreover, higher cost are involved in consistently obtaining reliable bonds between the cover and the base.

As can best be seen in FIGS. 2 and 7, the cavity 46 is formed with a plurality of longitudinally extending partitions 48—48 which are molded with the dielectric housing 40. The partitions 48—48 are in the form of toothed ridges with a plurality of conductor-receiving troughs 49—49 formed therebetween on 0.040 inch centers and opening to the free end 41. The conductor-receiving troughs 49—49 are designed to receive associated ones of the conductors 32—32 (see FIG. 7). Each of the troughs 49-49 is dimensioned so that the conductor 32 therein cannot move laterally. This is necessary to insure that during the insertion of the terminals 33—33, the terminals remain aligned with the conductors 32—32 to make electrical engagement therewith.

It may be observed from FIG. 2 that the bottoms of the troughs 49—49 are substantially coplanar with the top surface of the ledge 47 at the free end 41. This facilitates the use of the ledge 47 at the free end 41 as an anvil for conductor cut-off during assembly of the plug 24 to the cord 23.

As can best be seen in FIG. 4, the portion of the cavity 46 adjacent the cord-input end 42 communicates with the main portions of the conductor-receiving troughs 49-49 through a tapered transition section 51 having a shoulder 52. The partitions 48—48 are constructed to extend along a sloping face 53 of the tapered transition section 51.

After the jacket 31 of the cord 23 is stripped therefrom to expose a predetermined length of each of the insulated conductors 32—32, the cord is inserted into the input aperture 44 until the conductors 32—32 are moved along associated ones of the conductor-receiving troughs 49—49 extending down the sloping face 53. The portions of the partitions extending down the sloping face 53 assist in guiding the conductors 32—32 into the main portions of the troughs 49—49. As the conductors 32—32 are moved up the face 53, the jacketed portion of the cord 23 is being moved into the cavity 46. When the cord 23 has been advanced such that the conductors 32—32 are received in the troughs 49—49, the leading end of the jacket 31 is in engagement with the shoulder 52 (see FIG. 5).

Also, as can be seen in FIG. 4, the walls of the cavity 46 are formed to include a groove 56 longitudinally thereof. The groove 56 is designed to mate with cords having the ridge 38 formed externally of the jacket to insure that the cord 23 is inserted properly into the plug 24.

The housing 40 is also constructed with facilities for providing strain relief for the jacket and for the individual conductors 32—32. This feature permits the use of a one-piece molded plug rather than two parts assembled to the cord 23. As can best be seen in FIG. 4, the housing 40 is constructed with an opening 59 having a jacket-anchoring member 60 having an initially external facing portion 61. The anchoring member 60 is connected to the plug 24 through a plastic hinge 62 oriented toward the free end 41 of the housing 40 and extending from a wall 63. Referring now to FIG. 2, it is seen that the member 60 extends for only a portion of the width of the housing 40. Moreover, the member 60 is connected to the housing toward the cord-input end 42 thereof by a thin tapered, severable web 64 of dielectric material.

The configuration of the connecting web 64 is very important. As can best be seen in FIG. 8, the web 64 is constructed such that the dimension $d_1$, adjacent a wall 65 is substantially less than the dimension $d_2$ of the hinge 62 adjacent the wall 63. This intentional difference in dimensions serves two functions. It insures that the web 64 may be broken along the shearing plane along the dimension $d_1$ rather than along the dimension $d_2$. The shearing plane is a vertical plane adjacent the wall 65 along the thinnest portion of the web 64.

In order to describe the second function, attention is first directed to the anchoring member 60 having a surface 66 which protrudes slightly, e.g., 0.005 inch into the cavity 46 beyond an adjacent surface 67 of the remainder of the housing adjacent the cord-input aperture 44. The web 64 has its cavity-facing surface substantially planar with the cavity-facing surface 67 and connected to the surface 66 by a step or connecting surface 68 (see FIG. 8).

Figure 9:
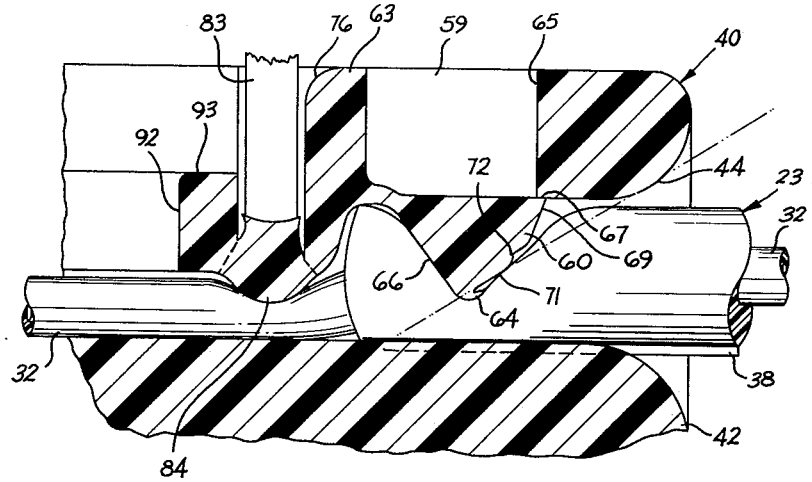

When forces are applied to the anchoring member 60 to move it from an initial to an actuated position, the web 64 together with the adjacent portion of the surface 66 forms a rounded trailing edge (see FIG. 9) of the hinged member 60 to be formed and wrapped counterclockwise as viewed in FIG. 9. Since this is the portion that is most deeply embedded into the cord, it is most advantageous that that there are no sharp burrs or edges to tear the material comprising the jacket 31. Rather, the trailing end curls around, as seen in FIG. 9, with the contour of the cord 23.

The wrap-around effect of the web 64 permits the development of a more effective resistance of the cord 23 to forces imparted to the cord during customer use. If the member 60 were simply hinged initially without the web 64 and moved pivotally to engage the cord 23, the member would bite into the jacket 31. Then, during use, forces imparted to the cord 23 could cause a cutting of the jacket 31. However, the use of the web 64 which connects the member 60 initially to the wall 65 and then is severed, forms a blunt portion which engages and clamps the jacket 31 while avoiding cutting into the jacket. This permits greater forces to be applied to the cord 23 without damaging the jacket 31 which could cause cord pull-out and loss of service because the conductors 32—32 would pull out.

This structural arrangement is not possible if the hinge 62 were oriented toward the cord-input end 42. To design a connecting surface 68 into that arrangement would create, undesirably, an undercut which cannot be molded. In the inventive design, the core pin (not shown) need only be stepped and can easily be removed.

The web 64 is also useful in maintaining the anchoring member in the initial position until after the cord end has been inserted. But for this, the member 60 could descend into the cavity either under its own weight or by forces imparted to the housing 40 during assembly, thereby obstructing entrance of the cord end.

The forces applied to the anchoring member 60, and pivotal movement thereof, causes the originally external facing portion 61 to be move forcefully along the side of the wall 65 of the opening 59 and then to catch under a lip formed by a portion of the surface 67 (see FIGS. 5 and 9). The extent of the engagement of the anchoring member 60 with the surface 67 is generally about 8 mils. As can be imagined, there is some compression of the portion 61 during this movement but once it is moved out of engagement with the side wall of the opening 59, its elastic memory properties facilitate a springback to its initial configuration with an accompanying catching under the lip surface 67.

This arrangement enhances the ability of the plug 24 to provide strain relief for the jacket which surprisingly continues to be effective with use of the cord 23. Retrograde forces applied to the cord by the customer during use, and directed to the right as viewed in FIG. 9, will cause the portion 61 to be maintained in locking engagement with the lip surface 67 thereby causing a still more effective locking of the web 64 with the cord jacket. Moreover, it has been observed that the continued application of forces or of excessively high forces to the cord 23, such as when the telephone set is suddenly pushed from a supporting surface, causes the anchoring member 60 to be moved slightly further along the lip surface 67 toward the cord-input aperture 46 thereby enhancing rather than deteriorating the anchoring of the cord. It has been found that if the hinge 62 were oriented toward the cord-input end of the housing 40 with the pivoted end under a ledge of a wall adjacent the free end of the housing, the application of retrograde forces to the cord would cause or tend to cause the anchoring member 60 to be moved out of engagement with the ledge thereby possibly impairing the strain relief of the cord jacket.

As can be seen in FIG. 9, the anchoring member is formed in a generally prismatic form having a generally triangular cross-section. Portion 61 of the anchoring member 60 is formed with two surfaces 69 and 71 connected by a step 72. The configuration is such that when the anchoring member is moved into the actuated position, the surface 71 is aligned with a tangent to a portion of the cord-input aperture 46 (see FIG. 9). This provides somewhat of a continuous support for the cord 23.

The unitary dielectric housing 40 is also formed with facilities to provide strain relief for the conductors 32—32. An opening 76 extends transversely across a portion of the housing 40 (see FIG. 2). As can be seen in FIG. 4 a conductor-anchoring member in the form of a restraining bar 77 of dielectric material spans the opening 76. A portion of the conductor restraining bar 77 is spaced from the main portion of the housing 40 by slots 78 and 79 (see FIGS. 4 and 8). The restraining bar 77 is integral with the walls of the opening 76 through connecting portions 81 and 82. As can be seen in FIG. 2, the ends of the restraining bar 77 of dielectric material are spaced from the end walls of the opening 76.

In this way, an operator may cause a specially adapted tool 83 (see FIG. 9) to reform the restraining bar 72 within the opening 76 to provide a generally wedge-shaped strain relief element 84 (see FIGS. 5 and 9) in engagement with ones of the individual conductors 32—32. Forces are applied to the restraining bar 77 to shear the bar along irregular planes. The resultant strain relief element 84 is of a generally trapezoidal cross-section with the larger dimension base in engagement with the conductors 32—32. The sloping walls of the element 84 engage with the walls of the opening 76 to lock the element in engagement with the conductors 32—32.

Figure 8:
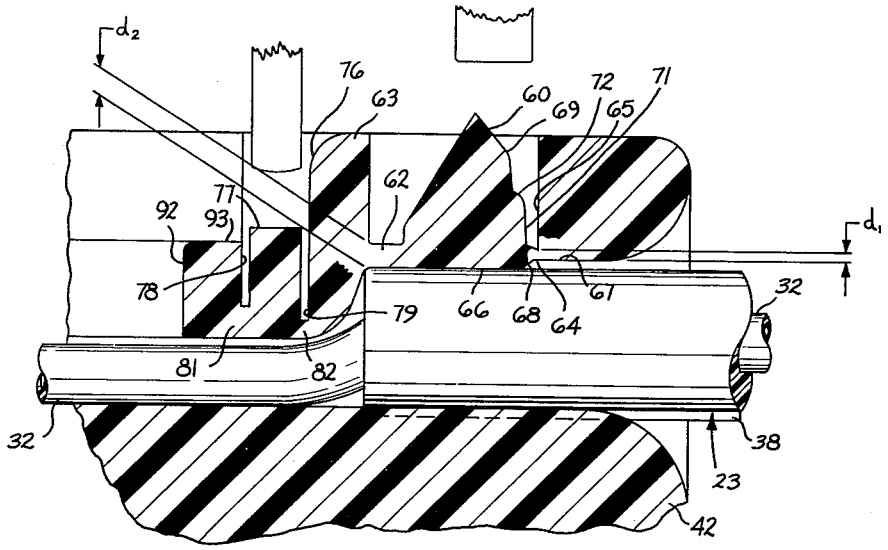
FIGS. 8 and 9 are enlarged detail views in elevation showing the use of tools to move the jacket strain relief member and to form the conductor strain relief member and with the tools and plug in an inverted position from that normally used for this operation.

While the embodiment shown in FIGS. 4 and 8, shows the pressure bar 77 separated from the housing 40 by the slots 78 and 79, it should be understood that other structural arrangements will suffice. For example, one of the slots 78 or 79, desirably the slot 79, may be extended to communicate with the cavity 46. Also, the restraining bar 77 may be molded so that forces applied thereto cause the bar to be moved linearly or pivotally to engage the conductors 32—32.

The use of the one-piece or unipartite dielectric housing 40 affords certain advantages. It permits an operator to simply insert a jacketed cord 23. Heretofore, separate or hinged portions (see application Ser. No. 311,575 filed Dec. 4, 1972 in the name of E. C. Hardesty, now U.S. Pat. No. 3,835,445) are mated together to secure the cord jacket and the conductors 32—32 within the assembled dielectric body. Finally, the terminals 33—33 are inserted into the assembled dielectric body.

In using a connecting device embodying the principles of this invention, there is no required bonding of mating portions with accompanying problems of alignment and quality of the bond. Moreover, the housing 40 has provisions molded therewith for securing the cord 23 to the plug and for alleviating strain relief on the cord jacket 31 and the conductors 32—32 during customer use. The jacket-anchoring member 60 and the conductor restraining bar 77 not only secure the plug 24 to the cord 23 but also provide strain relief for the jacket and the conductors, respectively.

In this way, the terminals 33—33 function only to make electrical contact with the conductors 32—32 and are not required to retain the conductors and resist the forces imparted to the conductors or the cord during customer use. The forces on the conductors 32—32 occur notwithstanding the anchoring of the jacket 31 with the member 60. While the pressure on the jacket 31 may prevent the insulation 37 of the conductors 32—32 from moving relative to the jacket, the pressure is not sufficient to prevent the nylon core 34 and ribbon 36 from moving relative to the insulation thereof during customer use. This occurs because the insulation 37 is tubed over the core 34 and nylon 36 wrapped about the core. Forces applied to the cord 23 by the subscriber tends to cause the cord 34 and ribbon to move slideably within the insulation 37. This movement, if unchecked, could cause the tinsel ribbon to be sheared off the core 34 at the engagement thereof with portions of the terminals 33—33.

The molding of the housing 40 with the ability to be able to precisely confine the conductors 32—32 in the troughs 49—49 is especially important. Prohibition against movement is necessary in order to cause the terminals 33—33 to penetrate the nylon-insulated conductors 32—32. The terminals 33—33 must be inserted with sufficiently high forces imparted thereto to penetrate the insulation. If the conductors 32—32 were free to move laterally of the plug, the terminals 33—33 may very well slice into the insulation on either side of the conductive elements and fail to establish engagement therewith.

As can best be seen in FIG. 2, the housing 40 is formed with a well 91 having a plurality of spaced parallel terminal-receiving openings 92—92 opening thereto. The openings 92—92 are in the form of slots and are aligned on a one-to-one basis with associated ones of the conductor-receiving troughs 49—49. Each of the terminal-receiving slots 92—92 is parallel to and communicates with an associated one of the conductor-receiving troughs 49—49. Each of the slots 92—92 is of a length slightly less than the out-to-out distance of that portion of the terminal 33 which is to be received therein. The shortening of the slots 92—92 from the overall length of the well 91 forms abutments 93—93 (see FIG. 4, for example).

The dielectric housing 40 is also formed with a plurality of fins 94—94 (see FIGS. 2, 3 and 7). The fins 94—94 are upstanding from a bottom surface 96 of the well 92 to which the terminal-receiving slots 92—92 open and are spaced on centers of approximately 0.040 inch. Also, the fins 94—94 are aligned between adjacent associated ones of the terminal-receiving slots 92—92. In this way, the external contacting components 27—27 of the jack 26 are received between the associated fins 94—94 and guided into engagement with portions of the terminals 33—33.

Formed integrally with the dielectric housing 40 is a resilient locking tab, designated generally by the numeral 101. The locking tab 101 is approximately 0.040 inch thick, 0.200 inch wide, and 0.500 inch long. The locking tab 101 is molded so that its longitudinal axis is oriented at an angle approximately 15 degrees with respect to the plane of the terminal-inserting side 43. The locking tab 101 is molded with a generally flat portion 102 connected by a plastic hinge 103 to the free end 41 of the housing 40 The portion 102 is stepped to form wings 104—104 adjacent a subscriber-contact portion 106.

Figure 10:
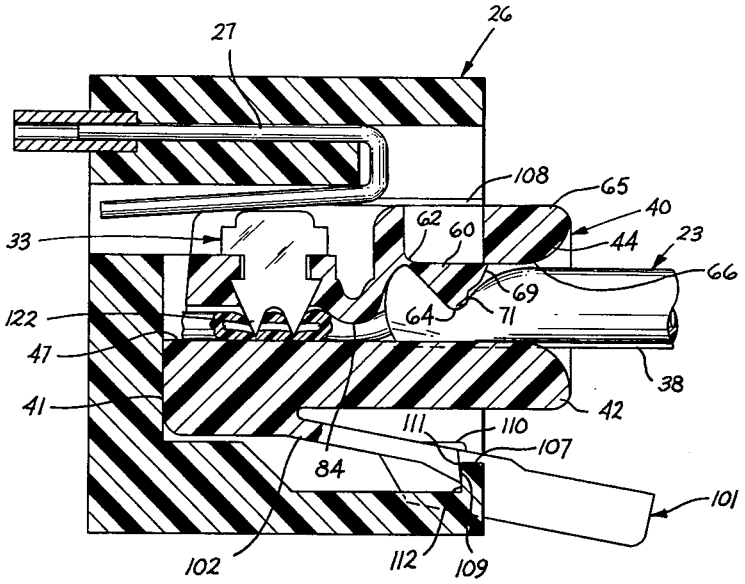
FIG. 10 is an elevational view partially in section and showing the plug inserted into a jack in a telephone set.

The combined height of the thickness of the locking tab 101 and resiliency of the locking tab permits the insertion of the plug 24 into the jack 26 between opposing surfaces 107 and 108 (see FIG. 10). The tab 101 can be deflected inwardly of the dielectric housing 40 to become substantially coplanar with the under-surface of the housing 40 and be moved slideably in engagement with the surface 107 which forms an entrance ledge (see FIG. 10). A stop 110 formed on the inwardly facing side of the flat portion 102 prevents an undue amount of deflection of the tab 101 during the insertion of the plug 24.

Figure 11:
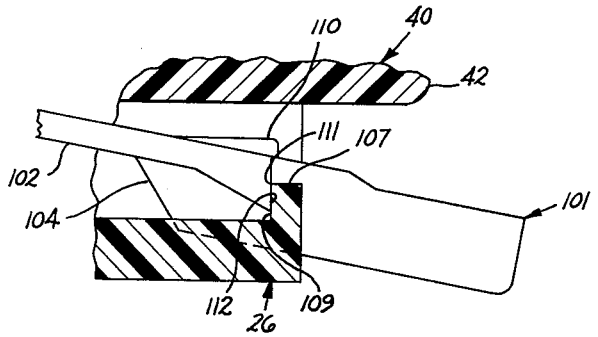
FIG. 11 is an enlarged detail view of a portion of latching facilities of the plug in engagement with surfaces of a jack in the telephone set.

After being released, the locking tab will essentially resume its original molded shape and orientation because of its natural resilience. Proper resilience to provide desired flexing properties can be incorporated into the locking tab 101 when it is molded from polycarbonate or other appropriate materials with the aforementioned dimensions. Return of the tab 101 to its originally molded shape causes the free end of the tab to be urged downwardly into seating engagement with surfaces of the jack 26 (see FIGS. 10 and 11) in the handset 22 and base 21. A wall 109 and the ledge surface 107 cooperate to form an edge 111 which engages with the wings 104—104 of the locking tab 101. This holds the plug 24 to the jack 26 in the handset 22 and insures integrity of the connection during customer use.

The locking tab 101 is designed to lock the plug in the handset 22 and to prevent removal thereof except under the application of the most abnormally high forces which distort or rupture the material of the housing 40. In order to accomplish this, the sloped portion of the tab 101 is constructed with shoulders 112—112 (see FIGS. 2 and 3). When the plug 24 has been inserted into the jack 26, the shoulders 112—112 engage the surface 109 (sse FIGS. 10 and 11) of the jack 26.

Terminals

As can best be seen in FIG. 2, each one of the terminals 33—33 is made from an electrically conductive resilient material such as Phosphor bronze. The terminal 33 has a flat conductive portion 121 with at least one contact or insulation-piercing tang 122 protruding therefrom. The tang 122—122 provide electrical connection between the conductive portion of the conductor 32—32 and the associated ones of the terminals 33—33.

Each of the blade-like terminals 33—33 also has an edge surface 123 having curved crowns 124—124 of predetermined radii. The crown 124 nearest the free end 41 of the housing 40 functions to complete the connection between the associated conductor 32 and an associated external-contacting component 27 illustrated in FIG. 10, and positioned in the telephone jack 26.

Provisions are also made for seating properly the terminals 33—33 within the associated terminal-receiving slots 92—92. Each of the terminals 33—33 is formed with shoulders 126—126 having necked-down portions 127—127 that terminate in barbs 128—128. As was indicated hereinbefore, the overall length of the terminal 33 out-to-out of the barbs 128—128 is greater than that of the length of the terminal-receiving slot 92. When the terminal 33 is inserted into the associated terminal-receiving slot 92, the barbs 128—128 penetrate the dielectric material which defines the slot to anchor the terminal (see FIG. 5).

The extent to which the terminal 33 is inserted into the associated slot 92 is determined by the operation of an apparatus (not shown) used to insert the terminals. Generally, that apparatus is controlled to insert the terminals 33—33 within the associated ones of the terminal-receiving slots 92—92 such that the shoulders 126—126 are spaced above the abutments 93-93.

The extent to which the terminal 33 is inserted into the associated terminal-receiving slot 92 is controlled to also insure that adequate electrical engagement is effected between the terminal tangs 122—122 and the conductors 32—32. If the depth of insertion is lacking, the tangs 122—122 may not engage one or both aligned portions of the helical tinsel ribbon 36. On the other hand if the depth of insertion is too great, the shoulders 126—126 could rupture the abutments 93—93. It is important that the tangs 122—122 engages the top of closest portion of the tinsel ribbon 36, be moved through the core 34, and into engagement with the bottom portion of the helically wrapped tinsel ribbon.

While the terminals 33-33 have been shown in a flat blade-like configuration, it should be obvious that they could be in the form of pins (not shown). Of course, the terminal-receiving openings 92—92 would then be molded to accommodate the pins (not shown) rather than the blade-like terminals 33—33.

ALTERNATE EMBODIMENT OF DIELECTRIC PORTION

There have been instances of contaminants and corrosive atmospheres penetrating the plug 24. This could cause problems in maintaining electrical continuity and reduction in the effectiveness of the electrical engagement between the terminals 33-33 and the cord 23.

Figure 6:
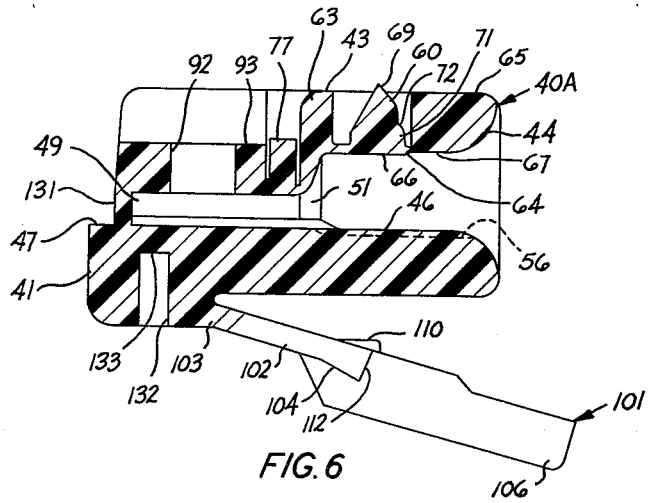
FIG. 6 is an elevational view showing an alternate embodiment in which one end of the plug housing is closed and in which additional conductor strain relief is provided.

In order to prevent such occurrences, the housing 40 of the plug may be modified to that designated 40A and shown in FIG. 6. The housing 40A is identical to the housing 40 except that the free end 41 has a wall 131 closing off the conductor-receiving troughs 49—49. This prevents any contaminants or unwanted atmospheric corrosives from entering the plug 24 at least from one end thereof adjacent the terminals 33—33. This creates an essentially hermetic seal.

In using the plug 24 having a modified housing 40A, the cord 23 must be stripped of the jacket 31 and then cut with some precision to expose only a predetermined length of the conductors 32—32. Then, when the cord 23 is inserted into the cavity 46 and the free end of the jacket 31 abuts the shoulder 52, the ends of the conductors 32—32 abut the wall 131.

The plug 24 may also be constructed with additional conductor restraining facilities. As can best be seen in FIG. 6, the housing 40A may include a well 132 being formed adjacent the free end 41 and having a conductor-restraining bar 133 formed therein. The conductor-restraining bar 133 is formed, is deformed and functions similar to those of the hereinbefore-described restraining bar 77. The inclusion of the restraining bar 133 provides additional strain relief for the individual conductors 49—49.

In the alternative embodiment and as shown in FIG. 6, the tab 101 may be formed with the surface 112 angled to engage the edge 111 of the jack instead of surface 109. While it disadvantageously compromises the lock-in of the plug 24, it advantageously releases the plug upon the application of excessive forces to the cord 23.

SECOND ALTERNATE EMBODIMENT OF DIELECTRIC PORTION

It will be recalled that the embodiment first described herein discloses that the cord 23 have the jacket 31 removed from a leading portion thereof to expose the individual insulated conductors 32—32. The individual conductors 32—32 are received in the conductor-receiving troughs 49—49.

The principles of this invention may be used to construct a housing 40 which may accommodate an end portion of a flat cord 23 without the necessity of removing the jacket from an end portion thereof. The cavity 46 is molded without the conductor-receiving troughs 49—49 and such that a leading end portion of the cord 23 is inserted into the cavity. The cavity 46 is constructed to communicate with the terminal-receiving slots 92—92 and may or may not open to the free end 41 of the housing 40 (see FIG. 6).

In using this embodiment, the end portion of the cord 23 is inserted into the cavity 46. Then the terminals 33-33 are driven into the slot 92—92 into engagement with the conductive elements of the cord 23. Since the cord 23 is flat, and assuming that the cord is inserted properly into the cavity 46, the conductive elements of the cord are aligned properly with the terminals 33—33.

METHOD OF ASSEMBLING PLUG WITH CORD

The construction of the plug 24 is especially adapted to be used with flat cordage. Moreover, the plug 24 is easily adapted to automated high speed manufacturing. The assembly of the plug 24 and the cord 23, is disclosed and claimed in application Ser. No. 377,154 filed July 6, 1973 of which this application is a continuation-in-part and which is incorporated by reference hereinto.

It is to be understood that the above described arrangements are simply illustrative of the invention. Other arrangements may be devised by those skilled in the art which will embody the principles of the invention and fall within the spirit and scope thereof.

I claim

1. An electrical connector for terminating a cord having a plurality of insulated conductors and for making electrical contact external to the connector, which comprises:

an unipartite dielectric housing having one free end with internal surfaces of the housing defining a cavity that opens to the other end of the housing for receiving and substantially enclosing an end portion of a cord, with at least one portion of the housing adjacent the cavity connected pivotally to the remainder of the housing toward the free end thereof and having a surface which protrudes into the cavity slightly beyond the adjacent surface of a portion of the remainder of the housing adjacent the cord-input end of the housing when the pivotally moveable portion is in an initial position, the pivotally connected portion capable of being moved from the initial position to an actuated position at least partially into the cavity with substantially all of the protruding surface engaging and clamping portions of the cord, and with a portion of another surface of the pivotally moveable portion engaging in locking relationship a portion of the remainder of the housing adjacent the cord-input end of the housing, the locking relationship being maintained during the application of retrograde forces to the cord; and a plurality of electrically conductive terminals positioned within the housing and extending between the cavity for piercing the insulation of and making electrical engagement with associated conductors of the cord and an external surface for making electrical contact external to the connector.

2. The electrical connector of claim 1, wherein the housing also includes a plurality of terminal-receiving openings communicating with the cavity and the exterior of the connector and each of the terminals includes:

a first contact portion extending into the cavity for piercing the insulation of and making electrical engagement with an associated conductor of the cord, and a second contact portion positioned within the associated terminal-receiving opening for making electrical contact external to the connector.

3. The electrical connector of claim 2, wherein the housing also includes condctor-receiving troughs formed in at least a portion of the cavity and the plurality of terminal-receiving openings communicating with the troughs and with the exterior of the connector.

4. The electrical connector of claim 3, wherein the moveable portion of the housing includes an anchoring member connected at one end through a hinged portion oriented toward the free end of the housing and the other end of the anchoring member oriented toward the cord-input end of the housing is connected severably to the remainder of the housing so that the application of forces for moving the anchoring member from the initial to the actuated position causes the other end of the anchoring member to be separated from the remainder of the housing.

5. The electrical connector of claim 4, wherein the anchoring member is connected severably to the housing through a web substantially planar with the adjacent surface of the portion of the remainder of the housing adjacent the cord-input end and which is connected to the surface of the moveable portion which protrudes into the cavity by a connecting surface and formed so that the application of forces causes the web to be separated from the remainder of the housing to form an elongated extension which is caused to assume a curved shape as the anchoring member is moved pivotally and together with the connecting surface to form a blunt portion which engages and clamps the cord without damaging the cord.

6. The electrical connector of claim 4, wherein the anchoring member is formed within an opening in the housing that extends toward the cavity and the pivotal movement of the anchoring member causes the anchoring member to lock under one of the walls defining the opening and adjacent the cord-input end to secure the anchoring member in engagement with the cord, the orientation of the hinged end and the separated end of the anchoring member with respect to the cord-input end tending to enhance the locking of the anchoring member in engagement with the one wall during the application of excessive forces imparted to the cord and directed outwardly of the cord-input end during use.

7. The electrical connector of claim 4, wherein one of the surfaces of the anchoring member which is externally facing when the anchoring member is in the initial position and which is adjacent the severable portion is stepped such that a portion thereof contiguous to the severable portion is moved into engagement with the cord, further the cord-input end of the housing having a flared entrance portion such that the portion of the stepped portion is aligned with a tangent to a portion of the flared entrance when the anchoring member is in the actuated position.

8. A device for terminating a cord, which comprises: an unipartite dielectric housing having one free end with internal surfaces of the housing defining a cavity that opens to the other end of the housing for receiving and substantially enclosing an end portion of a cord, with at least one portion of the housing adjacent the cavity connected pivotally to the remainder of the housing toward the free end thereof and having a surface which protrudes into the cavity slightly beyond the adjacent surface of a portion of the remiander of the housing adjacent the cord-input end of the housing when the pivotally moveable portion is in an initial position, the pivotally connected portion capable of being moved from the initial position to an actuated position at least partially into the cavity with substantially all of the protruding surface engaging and clamping portions of the cord, and with a portion of another surface of the pivotally moveable portion engaging in locking relationship a portion of the remainder of the housing adjacent the cord-input end of the housing, the locking relationship being maintained during the application of retrograde forces to the cord.

* * * * *